United States Patent [19]

Bruschek et al.

[11] 4,369,046

[45] Jan. 18, 1983

[54] PROCESS FOR MAKING AN ABRASIVE GRINDING WHEEL

[75] Inventors: Dieter K. Bruschek; Richard M. Levering, both of Wilmington, Del.

[73] Assignee: Abrasives International N.V., Curacao, Netherlands

[21] Appl. No.: 196,070

[22] Filed: Oct. 10, 1980

Related U.S. Application Data

[63] Continuation of Ser. No. 48,903, Jun. 15, 1979, abandoned, which is a continuation of Ser. No. 857,891, Dec. 6, 1977, abandoned, which is a continuation of Ser. No. 665,549, Mar. 10, 1976, abandoned.

[51] Int. Cl.[3] ..... C09K 3/14

[52] U.S. Cl. ..... 51/298; 51/293; 51/309

[58] Field of Search ..... 51/293, 295, 298, 309

[56] References Cited

U.S. PATENT DOCUMENTS

| | | | |
|---|---|---|---|
| 2,097,803 | 11/1937 | Sanford | 51/298 |
| 2,110,143 | 3/1938 | Ball et al. | 51/298 |
| 3,179,631 | 4/1965 | Endrey | 51/298 |
| 3,383,191 | 4/1968 | Thomas | 51/298 |
| 3,385,684 | 5/1968 | Voter | 51/298 |
| 3,471,276 | 10/1969 | Bragaw | 51/298 |
| 3,518,068 | 6/1970 | Gillis | 51/298 |
| 3,984,214 | 10/1976 | Pratt et al. | 51/298 |
| 4,042,347 | 8/1977 | Sioui | 51/298 |

*Primary Examiner*—Donald E. Czaja
*Assistant Examiner*—W. Thompson
*Attorney, Agent, or Firm*—Leblanc, Nolan, Shur & Nies

[57] ABSTRACT

Co-molded articles such as abrasive grinding wheel structures having a polyimide resin-bonded phase and a metal-bonded phase are provided. A process also is provided for co-molding such structures by the simultaneous application of heat and pressure to an abrasive-containing rim of polyimide resin and a core of metal powder.

10 Claims, 5 Drawing Figures

PROCESS FOR MAKING AN ABRASIVE GRINDING WHEEL

This is a continuation of application Ser. No. 48,903, filed June 15, 1979, now abandoned, which is a continuation of Ser. No. 857,891, filed Dec. 6, 1977, now abandoned, which in turn is a continuation of Ser. No. 665,549 filed Mar. 10, 1976, now abandoned.

The present invention relates to an article of manufacture and to a method of manufacture for fabricating such articles. More particularly, the present invention is directed to a co-molded article having a resin-bonded phase and a metal-bonded phase and to a method for co-molding shaped structures having an organic resin-bonded phase and a metal-bonded phase such as, for example, an abrasive grinding wheel having a metallic core member and a resin-bonded abrasive-containing rim member whereby to provide a unitary structure.

Abrasive structures such as grinding wheels having a rim member of polyimide polymeric material adhesively secured to a metallic core member are known. A significant problem with such structures resides in the lack of simple and efficient means for fastening the rim member to the core member. For example, if the rim-to-core adhesion is too low, the rim will strip-off during use. A considerable amount of effort has been directed toward obtaining grinding wheel structures having a rim fixedly secured to a core member. For example, U.S. Pat. No. 3,470,047 discloses an improved resin-bonded grinding wheel wherein a resin-bonded abrasive-containing rim member is adhesively secured to a core member in a manner so that the former exerts a compressive force upon the latter whereby the combination of the adhesive and the compressive stress will prevent lateral and radial disengagement of the rim from the core of the grinding wheel. Such efforts are costly and are not successful in all instances. Accordingly, it is the principal object of the present invention to provide shaped structures such as abrasive articles that are free of the above-mentioned drawbacks.

According to the present invention there is provided a co-molded article having an organic resin-bonded phase and a metal-bonded phase. The organic resin-bonded phase of the co-molded article comprises between 100 volume percent and about 30 volume percent of a substantially linear polyimide polymeric material, and the metal-bonded phase comprises between about 70 volume percent and 100 volume percent of metal powder. Suitable moldable and non-moldable additives may be present in each of the organic resin-bonded phase and the metal-bonded phase.

According to the present invention there also is provided a method of manufacture for fabricating shaped structures such as abrasive grinding wheel or hone structures having an organic resin-bonded phase and a metal-bonded phase which comprises co-molding said organic resin-bonded phase from a moldable resin mixture to provide a resin-bonded phase of between 100 volume percent and about 30 volume percent of a coalesced substantially linear polyimide polymeric powder and, complementally, of up to about 70 volume percent of a moldable metal powder, and said metal-bonded phase from a moldable metal mixture to provide a metal-bonded phase of between 100 volume percent and about 70 volume percent of moldable metal powder and, complementally, of up to about 30 volume percent of a substantially linear coalescible polyimide polymeric powder, by the application of heat and pressure simultaneously to said moldable mixtures.

The nature and advantages of the present invention will be more clearly understood from the following description and the several views illustrated in the accompanying drawings wherein like reference characters refer to the same parts throughout the several views and in which.

Figure 1:
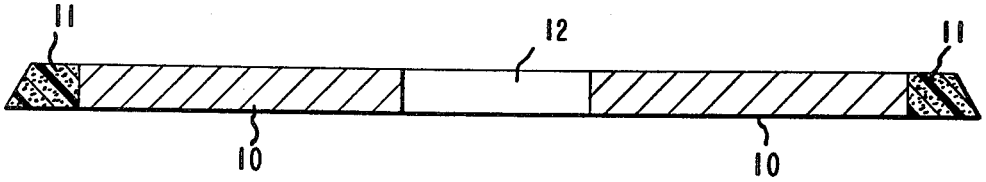
FIG. 1 is a cross-sectional view of a shaped structure consisting of a circular grinding wheel prepared in accordance with the method of the present invention.

The co-molded article of the present invention is of unitary construction and consists of at least two distinct homogeneous phases. One phase is denominated the organic resin-bonded phase and the second phase is termed the metal-bonded phase. Each phase may contain moldable and non-moldable additives, as desired. An example of a co-molded article of the invention is the grinding wheel depicted in FIG. 1. The shaped structure disclosed in FIG. 1 in illustration of the invention is an abrasive grinding wheel which comprises a core member 10 of metallic material and a rim member 11 of an organic polymeric material and a suitable abrasive material. Core member 10 is usually provided with an aperture 12 in the center thereof which is useful for mounting the grinding wheel on a suitable support member. FIG. 2 discloses a grinding wheel similar to that shown in FIG. 1, except that the abrasive-containing member 13 is disposed on surface 14 of core 10.

Figure 2:
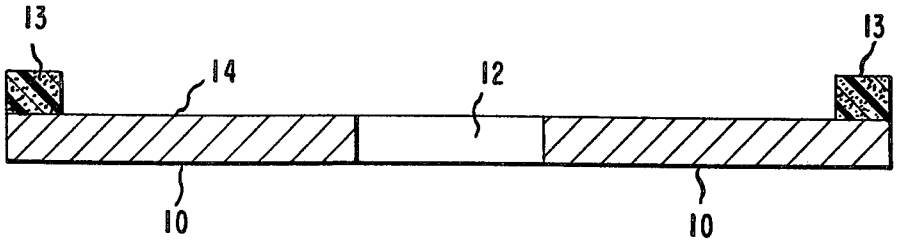
FIG. 2 is a cross-sectional view of another embodiment of a circular grinding wheel.

The organic resin-bonded phase of the co-molded article of the invention, as exemplified for instance by rim member 11 of the grinding wheel depicted in FIG. 1, comprises between 100 moldable volume percent and about 30 moldable volume percent of a substantially linear moldable polyimide polymeric material and, complementally, up to about 70 volume percent of a moldable metal powder. The foregoing moldable volume percent figures are based upon moldable material in the organic resin-bonded phase, excluding non-moldable additives such as abrasive particles. The organic resin-bonded phase preferably additionally contains abrasive particles such as, for example, diamond or coated diamond particles or silicon carbide. For instance, the organic resin-bonded phase may contain up to about 40 volume percent of additives such as diamond abrasive particles. By coated diamond is meant diamonds on which has been deposited electrolytically or chemically a thin layer of nickel or copper or silver, etc.

The polyimide polymeric material of the organic resin-bonded phase is characterized by the following recurring structural unit:

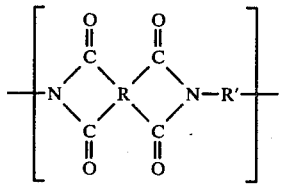

(1)

wherein R is a tetravalent aromatic radical containing at least one ring of six carbon atoms characterized by benzenoid unsaturation, the four carbonyl groups of said recurring structural unit being attached to separate carbon atoms in pairs with the carbonyl groups of each pair being attached to adjacent carbon atoms in said R radical; and wherein R′ is a divalent aromatic radical.

The polyimides are prepared by reacting at least one organic diamine having the structural formula:

$$H_2N—R'—NH_2 \quad (2)$$

wherein R′ is as above defined and the two amino groups of said diamine are each attached to separate carbon atoms of said aromatic radical, with at least one tetracarboxylic acid dianhydride having the structural formula:

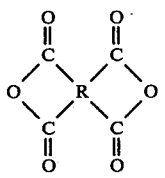

(3)

wherein R is as above defined, in an organic solvent for at least one of the reactants, the solvent being inert to the reactants, preferably under anhydrous conditions, for a time and at a temperature below 175° C. sufficient to form a polyamide acid which is then converted by suitable means such as by heating to the polyimide (1) above. Suitable polyimides for the method of the present invention are those based upon, for example, pyromellitic dianhydride and 4,4′-oxydianiline or based upon 3,3′,4,4′-benzophenone tetracarboxylic dianhydride and 4,4′-oxydianiline or metaphenylenediamine. Suitable polyimides are more extensively described in U.S. Pat. Nos. 3,179,631 and 3,249,588. The foregoing polyimides may be utilized either singly or in mixtures thereof in said resin-bonded phase.

The metal-bonded phase of the co-molded article of the invention, as exemplified for instance by core member 10 of the grinding wheel depicted in FIG. 1, comprises between about 70 volume percent and 100 volume percent of a moldable metal powder and, complementally, up to about 30 volume percent of a moldable filler material such as, for example, moldable polyimide polymeric material. Preferably, the metal powder is present in the metal-bonded phase from between about 80 volume percent and 100 volume percent. The metal powder for core member 10 is one preferably having a melting point of at least 100° C. above the molding temperature utilized. Suitable exemplary metal powders for the metal-bonded phase include copper, aluminum, brass and bronze. Suitable non-moldable additives may be added to the metal-bonded phase.

Figure 3:
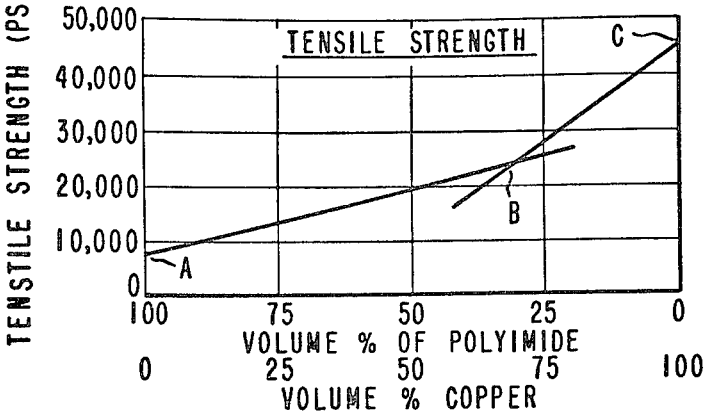
FIGS. 3, 4 and 5 are graphs of physical data of hot-pressed discs of mixtures of polyimide resin and copper metal powder.
Figure 4:
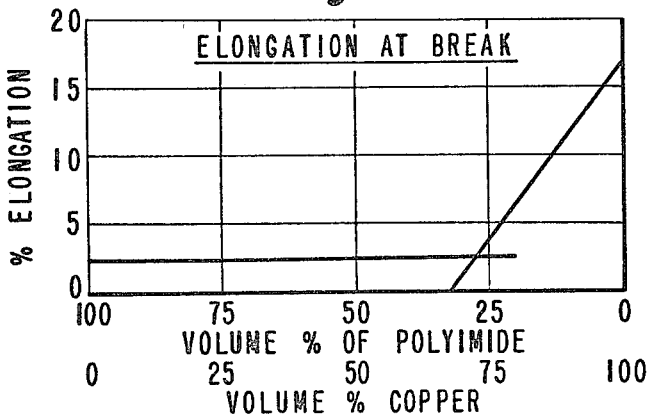
Figure 5:
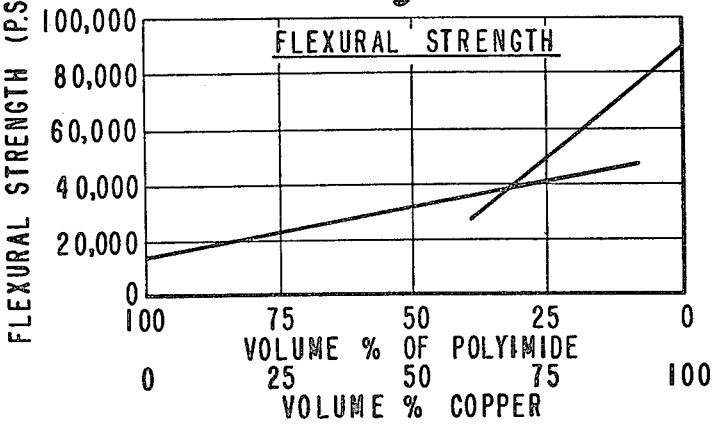

Additive materials may be incorporated into the organic resin-bonded phase, e.g., rim 11, or into the metal-bonded phase, e.g., core 10, as desired. For example, it may be desirable in some instances to add additive material to rim 11 to control the properties thereof. A moldable metal additive may be added to the moldable organic resin-bonded phase of rim 11 and a moldable resin additive may be added to the moldable metal-bonded phase of core 10. In this regard, an essential feature of the present invention resides in the discovery that the co-molding of the moldable organic resin-bonded phase and the moldable metal-bonded phase must be carried out under conditions wherein the organic resin-bonded phase comprises between 100 and about 30 volume percent of polyimide polymeric material and the metal-bonded phase comprises between about 70 and 100 volume percent of metal powder. Preferably, the organic resin-bonded phase, exclusive of any abrasive material, comprises between 100 and about 50 volume percent of polyimide. FIGS. 3 and 4 illustrate the basis for the foregoing essential feature of the invention. Specifically, FIG. 3 is a graph of tensile strength data plotted along the ordinate and volume percent plotted along the abscissa obtained from the analysis of a disc structure made by hot-pressing at 450° C. of a mixture of polyimide polymeric material (from pyromellitic dianhydride and 4,4′-oxydianiline) and copper metal powder. FIG. 3 shows that the tensile properties of the molded mixture of polyimide resin and copper metal changes at point B which shows that the continuous organic resin-bonded phase exists between A and B in FIG. 3 and that the continuous metal phase exists between points B and C in FIG. 3. The tensile strength of the continuous organic resin-bonded phase increases in a linear fashion from 100 volume percent of resin to about 30 volume percent of resin at which point there is an abrupt and marked change in the shape of the curve. The abrupt change indicates that the metal-bonded phase becomes continuous at point B in FIG. 3. The tensile strength of the continuous metal-bonded phase increases in a linear and expected fashion but at a much greater rate between about 70 volume percent of metal, point B, and 100 volume percent of metal, point C. FIGS. 4 and 5 show substantially similar results for the elongation at break and the flexural strength of the disc structures. Substantially the same results as depicted in FIGS. 3, 4 and 5 have been obtained for hot-pressed discs of polyimide polymeric material and aluminum powder.

The salient feature of the present invention resides in co-molding a moldable metal phase to obtain, for example, core 10, and a moldable organic resin phase to obtain, for example, rim 11. This is most preferably done by, for example, first filling a suitable mold having a core element with a moldable resin mixture such as polyimide powder, including any desired additives such as diamond abrasive particles. The mixture of moldable polyimide powder and diamond is partially compacted in the mold, and the core element of the mold is then removed. The core cavity of the mold is then filled with a moldable metal mixture of moldable metallic powder and any desired additives and partially compacted. Alternatively, the metal powder may be pre-formed in a separate operation and the resulting pre-form may then be placed into the core cavity of the mold. The mold and its contents are then heated between about 100° C. and 300° C. in a vacuum oven for anywhere between 15 minutes and 5 hours. The heated mold is then placed in a press and heated therein to between about 350° C. and about 500° C. A pressure of between about 4000 psi. and about 50,000 psi. is then applied to the mold for a period sufficient further to compact the pre-form and cause coalescence of both the resin and metal powders, e.g., 20–30 minutes. The mold is next cooled while still maintained under pressure, and after cooling the grinding wheel is removed from the mold. The grinding wheel is thereafter finished by conventional techniques, e.g., dressing, drilling of center mounting hole and balancing.

Any suitable molding technique may be employed for co-molding structures in accordance with the present invention. Satisfactory results have been obtained by using positive pressure molds and, particularly, positive pressure molds utilizing opposing rams.

The principle and practice of the present invention will now be illustrated by the following Examples which are only exemplary thereof and it is not intended that the invention be limited thereto since modifications in technique and operation will be apparent to anyone skilled in the art.

EXAMPLE 1

A blend of 2.40 g. poly-N,N'(4,4'-oxydiphenylene)-pyromellitimide, 13.64 g. dendritic copper powder and 10.13 g. nickel coated diamonds consisting of about 56% by weight of nickel (based upon the total weight of the coated diamonds), obtained by dry mixing, was leveled in the cavity formed by a cylindrical mold having a 6" I.D., a cylindrical core of 5.5" O.D. and two mold rings. The powder was pre-compacted using a pressure of 3,000 psi. The mold core was removed and the cavity filled with dendritic copper powder which was pre-compacted at 5,000 psi. to produce a preformed rim and core. The mold and its contents were heated in a vacuum oven at 150° C. for about four hours. The hot mold was installed in a press with platens heated to 450° C. and heated under contact pressure to 445° C. A pressure of 15,000 psi. was then applied for 20 minutes at 445°–450° C. to the mold. After cooling to 250° C., under pressure, the molded grinding wheel was ejected. Finishing operations, including dressing, drilling of center mounting hole, and balancing, produced a peripheral abrasive wheel with a diamond concentration of 100 (a diamond concentration of 100 means that there are 72 carats of diamonds per cubic inch). The molded grinding wheel rim (organic resin-bonded phase) composition was: 33 volume percent of polyimide; 30 volume percent of dendritic copper; and 37 volume percent of nickel coated diamonds (25 volume percent diamond and 12 volume percent nickel). The moldable material of the rim comprised 52 volume percent of polyimide and 48 volume percent of copper. The core (metal-bonded phase) composition was 100 volume percent of copper.

The grinding wheel was used for grinding cemented tungsten carbide until the rim was consumed without experiencing delamination or stripping of the rim member from the core member.

EXAMPLE 2

A 6-inch diameter D1A1 (American Standards Association) grinding wheel was prepared having a rim (resin phase) of poly-N,N'(4,4'-oxydiphenylene)-pyromellitimide and SiC, and a core (metal phase) of aluminum and poly-N,N'(4,4'-oxydiphenylene)-pyromellitimide of the following composition:

| | |
|---|---|
| Rim (Resin-Bonded Phase) | |
| Polyimide | 26 volume percent |
| Copper | 49 volume percent |
| SiC | 25 volume percent |
| Moldable Material | 34 volume percent polyimide and 66 volume percent copper |
| Core (Metal-Bonded Phase) | |
| Aluminum | 70 volume percent |

-continued

| | |
|---|---|
| Polyimide | 30 volume percent |

The resin and metal mixtures were co-molded at 450° C. and 12,500 psi. in accordance with the procedure described in Example 1 to provide a grinding wheel.

EXAMPLE 3

A $3\frac{1}{2}$-inch diameter chip was prepared having an abrasive layer (resin-bonded phase) of poly-N,N'(4,4'-oxydiphenylene)pyromellitimide and SiC, and a support (metal-bonded phase) of copper of the following composition:

| | |
|---|---|
| Abrasive Layer (Resin-Bonded Phase) | |
| Polyimide | 25.1 volume percent |
| Copper | 50.5 volume percent |
| SiC | 24.4 volume percent |
| Moldable Material | 33.3 volume percent polyimide and 66.7 volume percent copper |
| Support Layer (Metal-Bonded Phase) | |
| Copper | 100 volume percent |

The chip was molded at 450° C. and 25,000 psi. in accordance with the procedure described in Example 1 modified by preparing a preform of the abrasive layer by compacting the abrasive mixture and then adding a layer of copper powder thereon and compacting the layer of copper powder on the abrasive layer. The preform was co-molded at the above-mentioned temperature and pressure. Hone structures may be cut from the above-described chip moldings.

EXAMPLE 4

A 4-inch diameter D6A2 (American Standards Association) grinding wheel of the type shown in FIG. 2 of the following composition was prepared in accordance with the general procedure of Example 2 (using the polyimide of Example 2):

| | |
|---|---|
| Rim (Resin-Bonded Phase) | |
| Polyimide | 39 volume percent |
| Copper | 36 volume percent |
| SiC | 25 volume percent |
| Moldable Material | 52 volume percent polyimide and 48 volume percent copper |
| Core (Metal-Bonded Phase) | |
| Copper | 100 volume percent |

The resin and metal mixtures were co-molded at 450° C. and about 25,000 psi. to produce a grinding wheel.

EXAMPLE 5

A 6-inch diameter D1A1 grinding wheel of the following composition was prepared in accordance with the procedure of Example 2 (using the polyimide of Example 2):

| | |
|---|---|
| Rim (Resin-Bonded Phase) | |
| Polyimide | 63 volume percent |
| Diamond | 25 volume percent |
| Nickel Coating On Diamonds | 12 volume percent |
| Moldable | 100 volume percent |

-continued

| | |
|---|---|
| Material | polyimide |
| Core (Metal-Bonded Phase) | |
| Copper | 100 volume percent |

The resin and metal mixtures were co-molded at 450° C. and about 26,800 psi. to produce a grinding wheel.

EXAMPLE 6

A 6-inch diameter D1A1 grinding wheel of the following composition was prepared in accordance with the procedure of Example 2 (using the polyimide of Example 2):

| | |
|---|---|
| Rim (Resin-Bonded Phase) | |
| Polyimide | 33 volume percent |
| Copper | 30 volume percent |
| Diamond | 25 volume percent |
| Nickel Coating On Diamonds | 12 volume percent |
| Moldable Material | 52 volume percent polyimide and 48 volume percent copper. |
| Core (Metal-Bonded Phase) | |
| Copper | 100 volume percent |

The resin and metal mixtures were co-molded at 450° C. and about 26,800 psi. to obtain a grinding wheel.

EXAMPLE 7

A 6-inch diameter D1A1 grinding wheel of the following composition was prepared in accordance with the procedure of Example 2 (using the polyimide of Example 2):

| | |
|---|---|
| Rim (Resin-Bonded Phase) | |
| Polyimide | 33 volume percent |
| Copper | 30 volume percent |
| SiC | 37 volume percent |
| Moldable Material | 52 volume percent polyimide and 48 volume percent copper |
| Core (Metal-Bonded Phase) | |
| Copper | 100 volume percent |

The resin and metal mixtures were co-molded at 450° C. and about 15,600 psi. to provide a grinding wheel.

EXAMPLE 8

Three 6-inch diameter D1A1 grinding wheels of the following composition were prepared in accordance with the procedure of Example 2 (using the polyimide of Example 2); the rim composition of each wheel was identical, but the core composition was different:

| | |
|---|---|
| Rim (Resin-Bonded Phase) | |
| Polyimide | 33 volume percent |
| Copper | 30 volume percent |
| SiC | 37 volume percent |
| Moldable Material | 52 volume percent polyimide and 48 volume percent copper |
| Core (Metal-Bonded Phase) | |
| Wheel No. | |
| 1 | 28 volume percent Cu and 72 volume percent Al |
| 2 | 37 volume percent Cu and 63 volume percent Al |
| 3 | 50 volume percent Cu and 50 volume percent Al |

-continued

The resin and metal mixtures were co-molded at 450° C. and about 15,600 psi. to provide grinding wheels.

EXAMPLE 9

(a) A 3½-inch diameter chip of the following composition was prepared by pre-forming and co-molding a semi-circular section of a moldable resin mixture pre-form with a similar semi-circular section of a moldable metal pre-form.

| | |
|---|---|
| Resin-Bonded Phase | |
| Polyimide | 33 volume percent |
| Copper | 30 volume percent |
| SiC | 37 volume percent |
| Moldable Material | 52 volume percent polyimide and 48 volume percent copper |
| Metal-Bonded Phase | |
| Copper | 100 volume percent |

The chip was pre-formed at 3000 psi. and co-molded at 450° C. and about 30,000 psi. The bond between the resin-bonded phase and the metal-bonded phase was subjected to shear stress, and the bond strength was found to be an average value of 6550 psi.

(b) Microtensile bars were machined across the interface between the resin-bonded phase and the metal-bonded phase of chip structures described in (a) above. The microtensile bars were subjected to tensile analysis in accordance with ASTM-D-1708, and the tensile strength of the interface was found to be an average value of 5350 psi.

What is claimed is:

1. A process for making an abrasive grinding wheel having a substantially homogeneous organic resin-bonded phase rim containing inert abrasive particles and a substantially homogeneous metal-bonded phase core so bonded together at their annular interface as to resist delamination as the rim is consumed during the useful life of the instrument which comprises precompacting (a) said organic resin-bonded phase containing dispersed abrasive particles from a moldable resin mixture of between 100 volume percent and about 30 volume percent, based upon moldable material in said resin-bonded phase, of a substantially linear coalescible polyimide polymeric powder and, complementally, of up to about 70 volume percent of a moldable metal powder, based upon moldable material in said resin-bonded phase and (b) said metal-bonded phase from a moldable metal mixture of between 100 volume percent and about 70 volume percent of moldable metal powder, based upon moldable material in said metal-bonded phase, and complementally, of up to about 30 volume percent, based upon moldable material in said metal-bonded phase, of a substantially linear coalescible polyimide polymeric powder, to provide a preform unit wherein said phases are in interfacial contact along said annular interface, said moldable resin mixture being first pre-formed in a mold followed by pre-forming said moldable metal mixture in contact with said pre-formed moldable resin mixture in said mold, initially heating said preform unit to a temperature of about 100° C. to 300° C. in a vacuum for a time between fifteen minutes and five hours, and thereafter further heating said initially heated preform unit to a temperature of between about 350° C. and about 500° C. and conjointly applying a pressure to said further heated preform unit of between about 4,000 psi and about 50,000 psi for a period sufficient to cause coalescence of both said moldable resin and metal mixtures, and thereafter cooling the resulting shaped structure.

2. The process of claim 1 wherein said moldable metal mixture includes metal powders selected from the group of metals consisting of copper, aluminum, brass and bronze.

3. The process of claim 2 wherein said copper is dendritic copper.

4. The process of claim 1 wherein said abrasive particles are diamond particles.

5. The process of claim 4 wherein said diamond particles are metal coated diamond particles.

6. The process of claim 1 wherein said abrasive particles are SiC.

7. The process of claim 1 wherein said co-molding includes filling a mold having a removable shaped core with a substantially linear polyimide polymeric material having distributed abrasive particles and compacting said polyimide material around the periphery of said core; removing said core and filling the core cavity of said mold with the moldable metal mixture and compacting said moldable metal mixture; heating the mold to a temperature of about 100° C. to 300° C.; further heating said mold to a temperature of between about 305° C. and about 500° C. followed by applying a pressure to the material in said mold of between about 4,000 psi and about 50,000 psi; and thereafter cooling said mold.

8. The process of claim 1 wherein said polyimide is characterized by the following recurring structural unit:

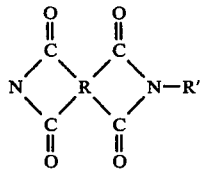

wherein R is a tetravalent aromatic radical containing at least one ring of six carbon atoms characterized by benzenoid unsaturation, the four carbonyl groups of said recurring structural unit being attached to separate carbon atoms in pairs with the carbonyl groups of each pair being attached to adjacent carbon atoms in said R radical; and wherein R′ is a divalent aromatic radical.

9. The process of claim 8 wherein said polyimide is derived from pyromellitic dianhydride and 4,4′-oxydianiline.

10. The process of claim 8 wherein said polyimide is derived from 3,3′,4,4′-benzophenone tetracarboxylic dianhydride and 4,4′-oxydianiline.

* * * * *